United States Patent [19]

Field

[11] Patent Number: 5,055,067

[45] Date of Patent: Oct. 8, 1991

[54] MODULAR PATCH PANEL FOR TELECOMMUNICATION SYSTEM

[75] Inventor: Michael D. Field, Hutchinson, Minn.

[73] Assignee: Communications Systems, Inc., Hector, Minn.

[21] Appl. No.: 484,373

[22] Filed: Feb. 23, 1990

[51] Int. Cl.[5] ..... H01R 13/514

[52] U.S. Cl. ..... 439/540

[58] Field of Search ..... 439/529, 532, 540, 541, 439/638–640

[56] References Cited

U.S. PATENT DOCUMENTS 4,073,563 2/1978 Bailey et al. ..... 439/532

4,353,614 10/1982 Etchison, Jr. et al. ..... 439/540

*Primary Examiner*—Gary F. Paumen

*Attorney, Agent, or Firm*—Kinney & Lange

[57] ABSTRACT

A modular patch or wiring administration panel comprises an elongated support that fits into a standard rack used for telecommunications. The panel has a plurality of openings on the front side thereof, each of which is of size to receive a standard communications socket. The openings are divided into pairs by anchoring lugs positioned between the openings which are accessible from the rear side of the panel. A two port or opening module is provided and held in each of the supports, and each of the two port modules is made to accept a wide variety of line connection devices, either male or female, so that the same panel can have many variations of connections. The two port module permits movement of the module within the panel, for better space utilization. For example, an input jack and an output jack on the same module and on the same panel, and termination units are easily connected at the rear of each of the modules.

5 Claims, 3 Drawing Sheets

10
11
12
15
17
30
31A
31B
33
34
52
56
60
61
62
63
70
71

16
20
21
22
23
40
50
56
57
64
65
66
67
68
69

MODULAR PATCH PANEL FOR TELECOMMUNICATION SYSTEM

BACKGROUND OF THE INVENTION

The present invention relates to a modular patch or wiring administration panel that comprises a housing having a number of two port modules that allows custom configuration of voice and data connections in each of the panels.

In the prior art, there have been patch panels developed which modularize connections that typically have banks of 66 clips, coaxial baluns or other modes of termination at the rear, and corresponding modular jack outputs at the front. Riser cables are connected at the rear of the panel, to bring telecommunication circuits from the building entrance to the desired area. The riser cables are connected at the rear of the panel. Patch cords are used in the prior art systems to extend the circuit to another jack panel. Individual station wires are then distributed from the back of the second panel. In other words, this arrangement has two panels with patch cords connected between the panels, and to connect, move or disconnect a terminal or telephone, one has to unplug the patch cord and select a new input or output jack.

The present invention utilizes standard jacks, plugs, and other components, but has the jacks, plugs and components mounted to modular adapters for custom configuration of a patch panel.

SUMMARY OF THE INVENTION

The present invention relates to a multiport modular patch panel for custom configuration of voice and data connections. The panel comprises a frame or housing that fits into support racks commonly used in telecommunication equipment closets, and has a front wall with a plurality of ports of size to receive standard data and voice transmission connection jacks. The frame also has a plurality of module support members, that open toward the rear of the frame or housing. Each module support member is aligned with a separate pair of the ports in the front wall. A plurality of connection modules are provided, each of which supports two connectors that fit adjacent ports on the frame and is made to support a wide variety of different types of connectors on the modules at the rear wall of the housing as well as the front ports.

The modules and terminals can be moved within the frame quite easily. This permits better utilization of panel mounting frames or housings in a wide variety of different types of telecommunication needs for distribution from input and output telecommunication systems from a building entrance to the desired area within the building.

The components are easily manufactured, and the two jack modules that are used have universal connections thereon for receiving different types of connectors and output jacks, as well as space for mounting balun transformers that may be needed.

DETAILED DESCRIPTION OF THE PREFERRED EMBODIMENTS

Figure 1:
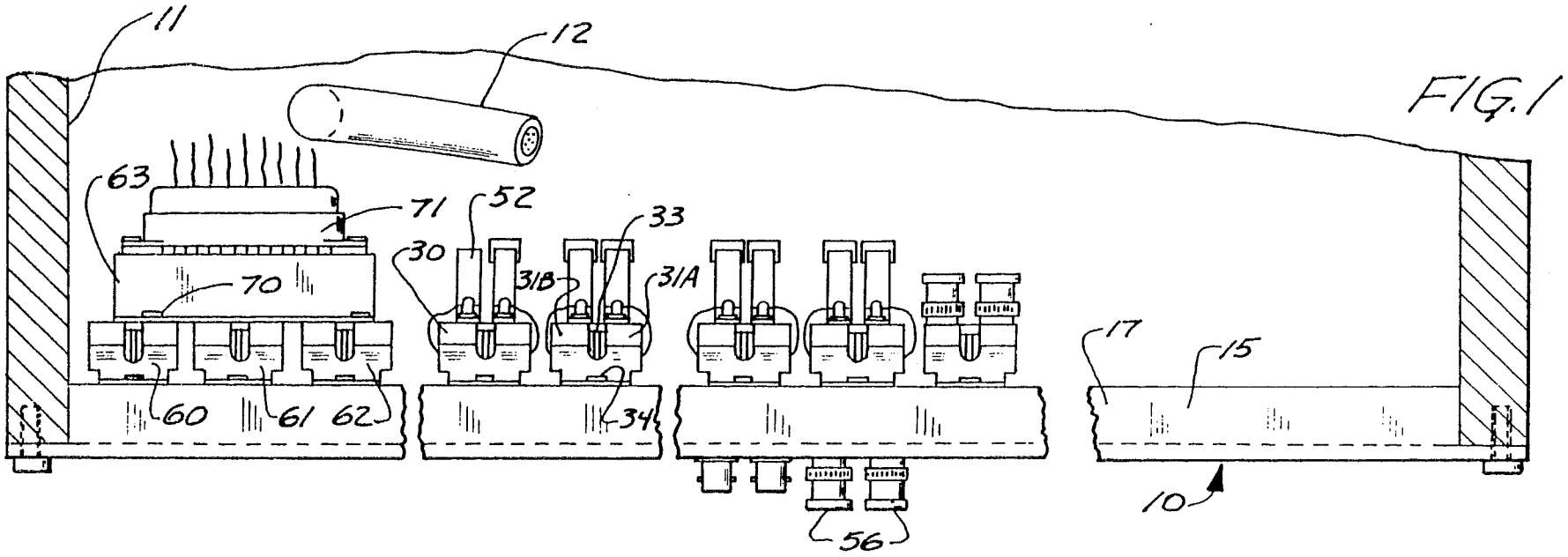
FIG. 1 is a top plan view of a typical patch panel having mounting modules made according to the present invention installed thereon.

A wiring patch or administration panel indicated generally at 10, which is made according to the present invention, is mounted in a rack 11 that is conventionally made and is commonly used in telecommunication equipment closets.

Suitable communication input cables such as those schematically indicated at 12 are used for carrying the telecommunication circuits from the building entrance up to the panel. The panel is an elongated housing or frame, which can be mounted vertically with additional frames in a cabinet, although only one housing is shown. The frame or housing 15 of the panel is an open backed enclosure that includes a multiport front wall 16, a top wall 17, and a bottom wall 18 (see FIGS. 3 and 5 for example).

Figure 2:
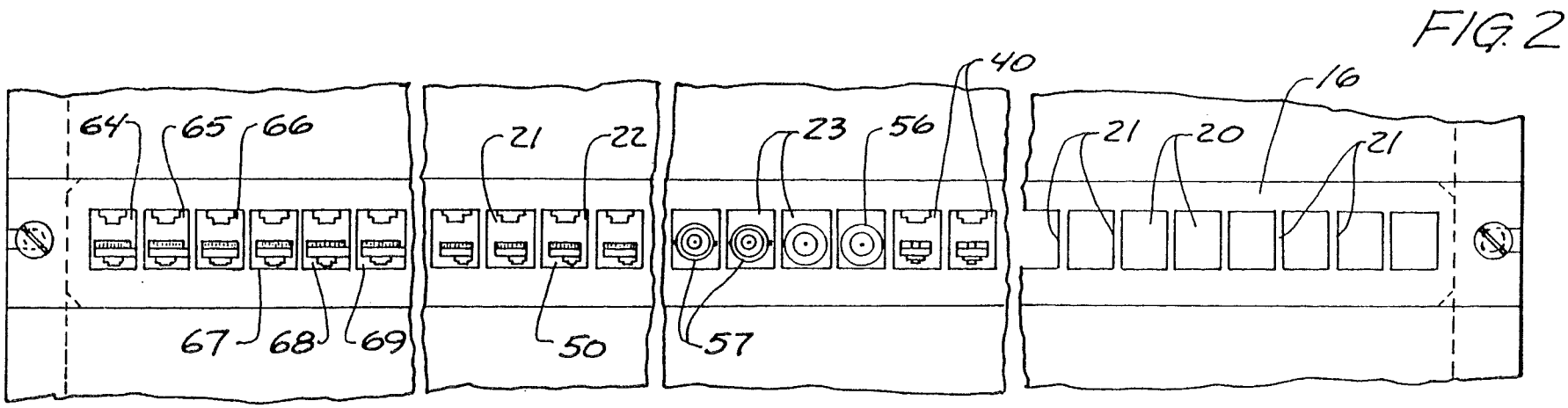
FIG. 2 is a front view of the patch panel of FIG. 1 showing various ports in use on the front wall.

The individual ports 20, which are shown in FIG. 2, are divided by divider bars 21. As shown, the ports 20 are of size to receive the outer end portions of conventional modular jack blocks, which are indicated generally at 22, and other types of mounting blocks 23, which are of the same size as the jack blocks and which are used for mounting BNC or other connectors.

Figure 4:
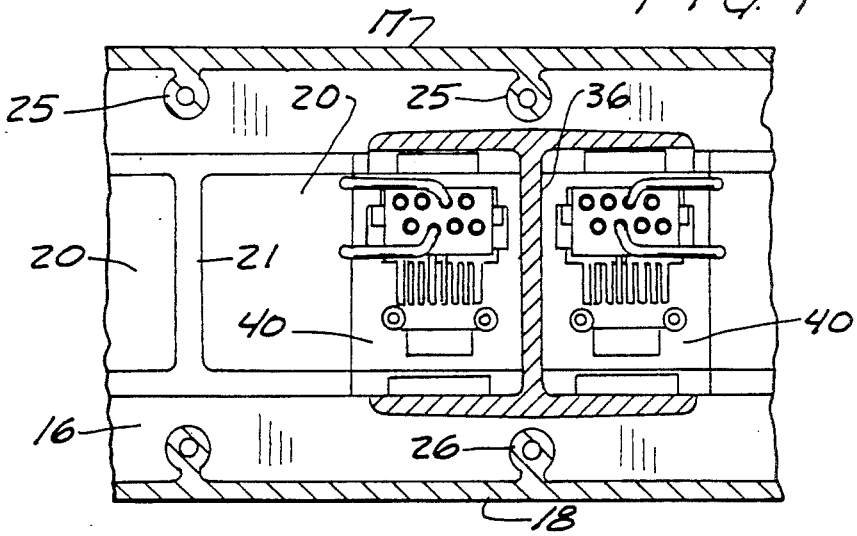
FIG. 4 is a sectional view taken as on line 4—4 in FIG. 3.

The top and bottom walls 17 and 18 are provided with integrally molded front to rear extending screw supporting hubs 25 and 26, respectively (see FIG. 4). One set of the hubs 25 and 26 are used for mounting a double block support module indicated generally at 30. A set of screw mounting hubs 25 and 26 are aligned with every other one of the divider bars 21, so that there is one set of the screw mounting hubs for each two ports 20. The double block modules 30 are made to support two individual jack blocks, and hold them in position so that when the double block module 30 is mounted onto a hub 25 and a hub 26, the jack blocks will align with and the outer ends will be positioned in the individual ports 20 in the front wall 16 of the patch or wiring administration panel.

Each of the modules 30 is a molded assembly, which includes a rear section 31, support ears 32,32 at the top and bottom, and a jack block mounting section 33. The rear section 31 is divided into two halves, as shown at 31A and 31B, with a groove 34 between these halves. The groove permits access to the two screws indicated at 34A that are used for mounting the module by extending through the ears 32 and into the screw hubs 25 and 26. The rear section 30 has a rear wall 35. A vertical divider mounting wall 36 is molded to the rear wall and extends forwardly, and extends into the front block mounting section 33. The wall 36 forms a mounting wall and divides the halves of the module.

Figure 5:
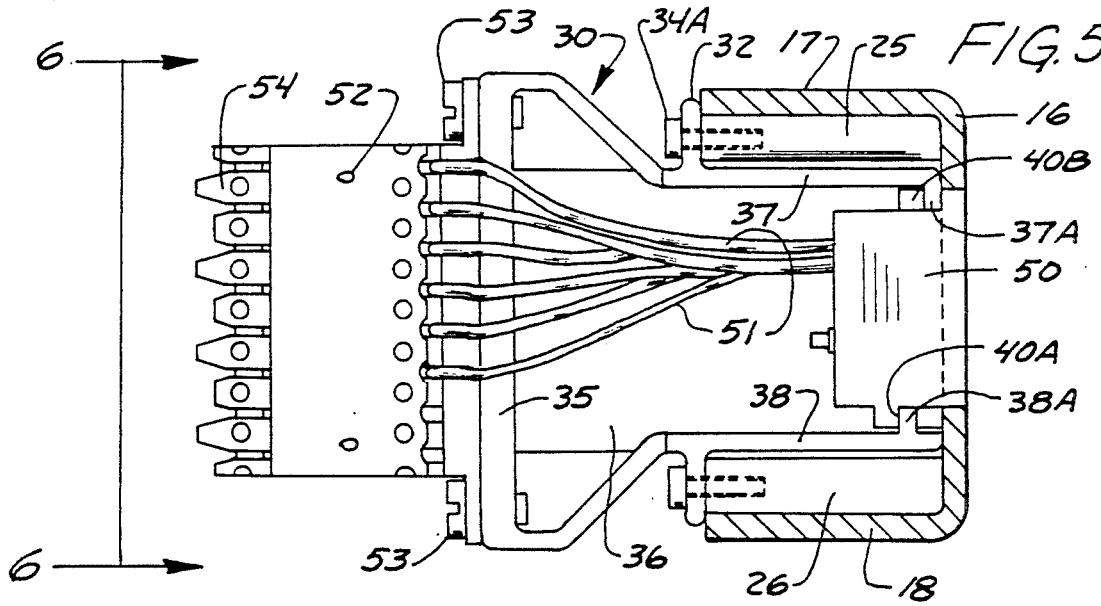
FIG. 5 is a side elevational view of a module such as that shown in FIG. 3 with a different type of connection arrangement.
Figure 7:
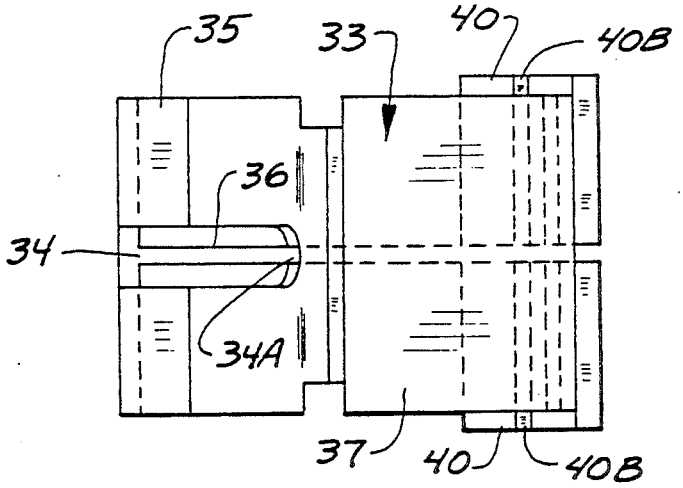
FIG. 7 is a top plan view of a module made according to the present invention.

The front jack block mounting section of the module has a top wall 37, a bottom wall 38, and at the forward edge has turned in upper and lower lips 37A and 38A, respectively. The walls 37 and 38 are fixed to the mounting wall 36 and are spaced vertically sufficiently to permit a jack block 40 to be slid into position with the lip 38A received in a groove 40A and with lip 37A to the front of a rib 40B formed in the standard jack blocks 40 for retaining the jack block in position. The jack blocks 40 are positioned on opposite sides of the mounting wall 36, as can be seen in FIGS. 5 and 7, for example. The top wall 37 and the bottom wall 38 at least partially encloses the jack block 40.

Figure 3:
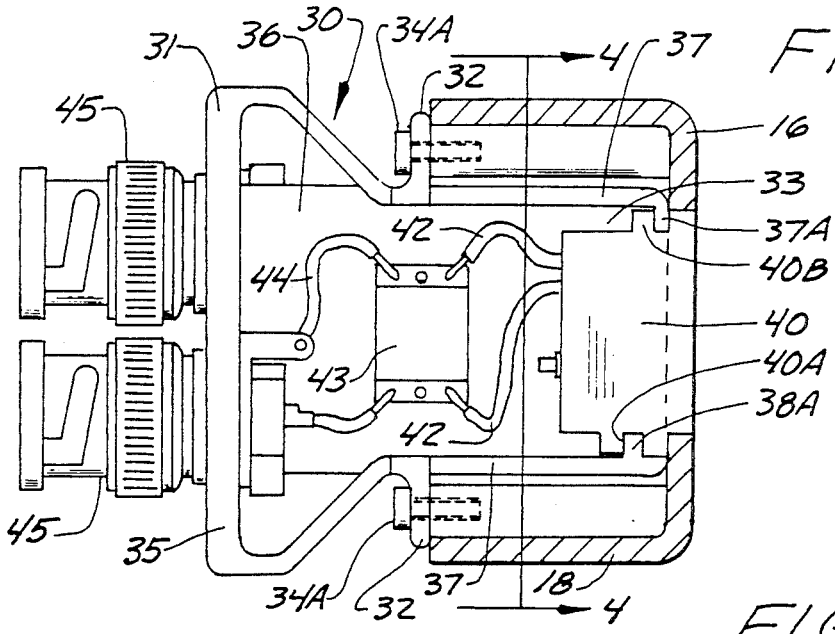
FIG. 3 is a side elevational view of a two port module made according to the present invention.
Figure 8:
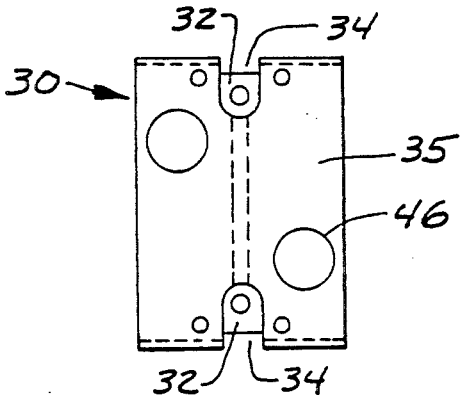
FIG. 8 is a rear elevational view of the module of FIG. 7.

The rear wall 35 is of greater vertical dimension than the front section 33, and it can be seen that the upper and lower walls 37 and 38 of the front section 33 slid in between the hubs 25 and 26 that hold the screws for retaining the module in place. The rear wall 35 thus has enough vertical height to mount a number of different types of connectors. As can be seen in FIG. 2, the individual modules 30 can be mounted at desired locations, and can have different types of connectors thereon. In FIG. 3, standard module data communication connectors are housed in the jack blocks 40, and a pair of wires 42 are connected to a balun transformer 43 that can be mounted directly to the side surface of the mounting wall 36. The balun transformer 43 is then connected with wires 44 to a female BNC connector 45 that can be clamped against the back wall 35 and mounted in a suitable opening, such as that shown at 46 in FIG. 8.

A second BNC connector 45 is also shown above the first in the side view of FIG. 3, and the top connector 45 is connected to a similar jack block 40 and balun transformer on the opposite side of the wall 36 and connected to the jack block 40 as shown in FIG. 4.

A similar connection is shown in FIG. 5, with a module 30 in place in the housing or panel. The module 30 is constructed just as the module shown in FIG. 3, but in this case, a jack block 50, which is the same outer construction as the jack block 40 has a plurality of wires 51 leading therefrom. The jack block 50 is a telecommunications modular jack for home telephones so it has the number of leads needed for telephone modular jacks. The wires 51 in turn are connected to an IDC connector 52 that has mounting flanges that are mounted with suitable screws 53 to provided openings in the rear wall 35 of the module 30. The IDC connectors have input connections at suitable terminals indicated at 54, in a conventional manner that are provided from wires in the cables 12.

Figure 6:
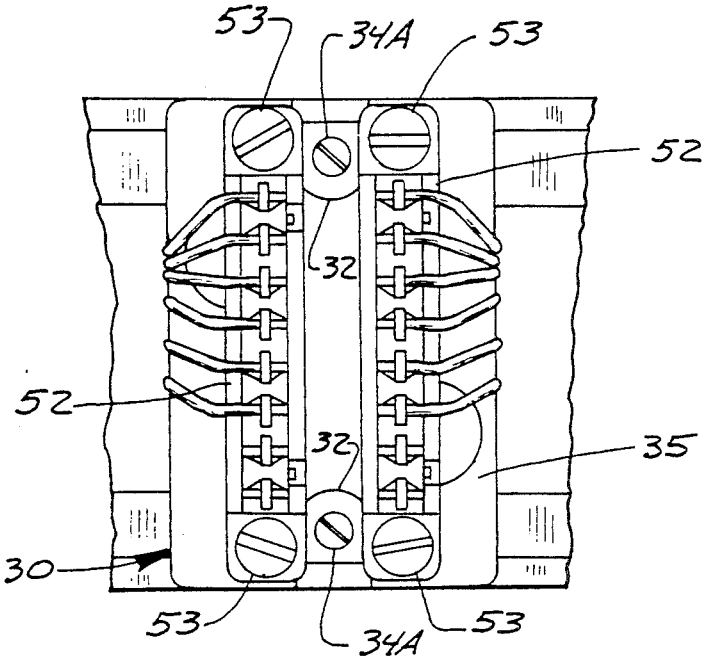
FIG. 6 is a rear elevational view of the device of FIG. 5, taken as on line 6—6 in FIG. 5.

FIG. 6 is a rear view of FIG. 5, and shows two IDC connectors in position held by screws 53 on the rear wall 35. The screw holes for screws 53 can also be seen in FIG. 8 which is a rear view of the two port module 30 without connectors in place.

As shown in FIG. 2, in addition to the data communication jack blocks 40, blocks can be used in the modules to mount other connection devices such as female BNC connectors 56 at the front outlet ports, or male BNC connectors 57, shown in FIG. and 2. Suitable telephone jack blocks are shown at 50 with the IDC connectors 52 on the backside of the module.

The versatility of the use of the line connection device block mounting modules that utilize two ports on the panel wall 16 is shown by illustrating three of the individual two port modules indicated at 60, 61, and 62, respectively that are all connected directly to a single standard twenty-five pair connector plug indicated at 63. The adapter or connector plug is connected to communication jacks 64, 65, 66, 67, 68 and 69 shown in FIG. 2. The twenty five pair connector plug 63 mounts directly onto the modules 30 with suitable screws 70, and has a fitting 71 that can be used for connecting to a standard twenty five pair plug that has twenty five pairs of communication wire for use in telephone systems. Thus, the modules 30 that are made so that they provide connector blocks through two ports on the panel, and provide versatile ability to connect different types of fittings or connectors, and are easily moved within the panel or housing by removing two screws. The mounting walls 36 have surfaces for mounting the balun transformers for use in data communication, or other components, and BNC connectors can easily be mounted in place.

The BNC connectors such as those shown at 56 and 57 are adapted to be mounted onto blocks that have the same outer dimensions and which also have the grooves and ribs for mounting on lips 37A and 38A, as the standard jack block 40 or 50.

The various connectors (jack, plugs, BNC, IDC, male and female connectors) are all line connector devices used for telecommunication lines.

Although the present invention has been described with reference to preferred embodiments, workers skilled in the art will recognize that changes may be made in form and detail without departing from the spirit and scope of the invention.

What is claimed is:

1. A module for mounting telecommunication connection devices into a panel for holding a plurality of such modules, said modules each comprising a mounting wall, said mounting wall having a first plane and extending in front to rear directions, first means on said mounting wall at a front end thereof for retaining first line connection device blocks in positions on each of opposite sides of said mounting wall, a rear wall at a rear end of said mounting wall spaced from said first means for mounting said connection device blocks, said rear wall defining a plane perpendicular to the plane of the mounting wall, second means on said read wall for mounting second line connection devices on the rear wall, and positioned to align with opposite sides of said mounting wall whereby the first line connection device blocks retained on the first means are connectable to the second line connection devices on the respective opposite sides of said mounting wall, said module further having upper and lower walls having planes perpendicular to the mounting wall and joined to and extending laterally from the mounting wall to define a module housing for supporting and at least partially enclosing the first line connection devices.

2. The module of claim 1 wherein the spacing between the first line connection device blocks mounted on said module is the same amount as the spacing of adjacent ports in the panel, and wherein a plurality of said modules are mounted in adjacent ports in the panel provide support for a multiple wire connection unit.

3. A combination of a panel housing and modules for mounting in said panel housing for telecommunication connections, said panel housing comprising a front wall defining a plurality of ports that are uniformly spaced along a length of said front wall, and top and bottom walls connected to and extending generally perpendicular to said front wall to define the panel housing, said ports being separated by divider bars, and screw receiving means on said top and bottom walls adjacent edges of the top and bottom walls spaced from the front wall, the modules being mounted between the top and bottom walls and each module comprising a mounting wall positioned to be generally parallel to the divider bars between the ports and having side surfaces thereon, and top and bottom module walls generally parallel to the top and bottom walls of the panel housing and integrally molded to the mounting wall, the module top and bottom walls being spaced so they will slip between the top and bottom walls of the panel housing, means on said module top and bottom walls for supporting a separate first line connection device block between the module top and bottom walls on each side of the mounting wall, a rear mounting portion of said module being positioned to protrude beyond rear edges of the top and bottom walls of the panel housing, the rear mounting portion comprising a rear module wall generally parallel to the front wall of the panel housing and integrally molded to the mounting wall, said rear module wall having means thereon for supporting second line connection devices associated with the respective first line connection device blocks, means for permitting screws to pass through a portion of the module and engage the screw mounting means on the top and bottom walls of the panel housing for holding the module in a position in the panel housing wherein the first line connection device blocks are accessible through the ports of the front wall of the panel housing, and communication components mounted on the side surfaces of the mounting wall of the module and connected between the first connection device blocks and second line connection devices mounted on the respective sides of said mounting wall on said module.

4. The combination as specified in claim 3 wherein said module has a pair of ears, one at the top thereof and one on the bottom thereof for mounting to the panel housing, and wherein said rear module wall and the means joining the rear module wall to the mounting wall define a recess to permit access to screws in said ears, said top and bottom walls of said panel housing having means providing openings into which the screws can be threaded.

5. A combination of a panel housing and modules for mounting in said panel housing for telecommunication connections, said panel housing comprising a front wall defining a plurality of ports that are uniformly spaced along a length of said front wall, and top and bottom walls connected to and extending generally perpendicular to said front wall to define the panel housing, said ports being separated by divider bars, and screw receiving means on said top and bottom walls adjacent edges of the top and bottom walls spaced from the front wall, the modules being mounted between the top and bottom walls and each module comprising a mounting wall positioned to be generally parallel to the divider bars between the ports and having side surfaces thereon, and top and bottom module walls generally parallel to the top and bottom walls of the panel housing and integrally molded to the mounting wall, the module top and bottom walls being spaced so they will slip between the top and bottom walls of the panel housing, means on said module top and bottom walls for supporting a separate first line connection device block between the module top and bottom walls on each side of the mounting wall, a rear mounting portion of said module being positioned to protrude beyond rear edges of the top and bottom walls of the panel housing, the rear mounting portion comprising a rear module wall generally parallel to the front wall of the panel housing and integrally molded to the mounting wall, said rear module wall having means thereon for supporting second line connection devices associated with the respective first line connection device blocks, means for permitting screws to pass through a portion of the module and engage the screw mounting means on the top and bottom walls of the panel housing for holding the module in a position in the panel housing wherein the first line connection device blocks are accessible through the ports of the front wall of the panel housing, wherein said panel housing has mounting means for mounting a plurality of modules greater than three along the length thereof at selected ports, and wherein three modules mounted together in the panel housing provide support surfaces for a 25 pair communication connection device on the rear module walls of the three modules mounted on the panel housing.

* * * * *

UNITED STATES PATENT AND TRADEMARK OFFICE

CERTIFICATE OF CORRECTION

PATENT NO. : 5,055,067

DATED : October 8, 1991

INVENTOR(S) : Michael D. Field

It is certified that error appears in the above-identified patent and that said Letters Patent is hereby corrected as shown below:

Col. 4, line 40, delete "read" and insert --rear--.

Signed and Sealed this

Twenty-third Day of February, 1993

*Attest:*

STEPHEN G. KUNIN

*Attesting Officer*

*Acting Commissioner of Patents and Trademarks*